US008733924B2

(12) United States Patent
Yamagishi et al.

(10) Patent No.: US 8,733,924 B2
(45) Date of Patent: May 27, 2014

(54) INKJET PRINTER HAVING PLATEN PLATE WITH SUCTION HOLES

(75) Inventors: Ryota Yamagishi, Ibaraki-ken (JP); Tomohiko Shimoda, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 64 days.

(21) Appl. No.: 13/232,256

(22) Filed: Sep. 14, 2011

(65) Prior Publication Data

US 2012/0069085 A1 Mar. 22, 2012

(30) Foreign Application Priority Data

Sep. 17, 2010 (JP) ..... P2010-209762

(51) Int. Cl.
*B41J 11/00* (2006.01)

(52) U.S. Cl.
CPC ..... *B41J 11/0085* (2013.01); *B65H 2406/3223* (2013.01)
USPC ..... 347/104; 271/267

(58) Field of Classification Search
CPC ..... B41J 11/0085
USPC ..... 347/104
See application file for complete search history.

(56) References Cited

U.S. PATENT DOCUMENTS

| | | | | |
|---|---|---|---|---|
| 2002/0097311 | A1* | 7/2002 | Hinojosa et al. | 347/104 |
| 2002/0167578 | A1* | 11/2002 | Miki et al. | 347/104 |
| 2003/0084811 | A1* | 5/2003 | Ishii et al. | 101/494 |
| 2004/0066445 | A1* | 4/2004 | Bruhn | 347/104 |
| 2004/0245700 | A1* | 12/2004 | Asada et al. | 271/109 |
| 2004/0263601 | A1* | 12/2004 | Ishii et al. | 347/104 |
| 2005/0024461 | A1* | 2/2005 | Ishii et al. | 347/104 |
| 2007/0291096 | A1* | 12/2007 | Toyoshima | 347/104 |
| 2011/0242220 | A1* | 10/2011 | Yamagishi et al. | 347/47 |

FOREIGN PATENT DOCUMENTS

JP 2007-31007 A 2/2007

* cited by examiner

*Primary Examiner* — Shelby Fidler
(74) *Attorney, Agent, or Firm* — Nath, Goldberg & Meyer; Jerald L. Meyer

(57) ABSTRACT

An inkjet printer 10 includes a platen plate 4 that has recess portions 41 and suction holes 42, and an inkjet type print head that has arrays of ink discharge nozzles right above the recess portions 41. Each suction hole 42 is set to have a first flow rate of air in a first suction path, and a second flow rate of air in a second suction path. The first suction path is made by the suction hole 42, and one of regions extending at a recess portion 41 of the platen plate 4, with the suction hole 42 intervening in between in a transfer direction. The arrays of ink discharge nozzles are disposed in the one region. The second suction path is made by the suction hole 42 and the other region at the recess portion 41. The second flow rate is smaller than the first flow rate.

5 Claims, 8 Drawing Sheets

INKJET PRINTER HAVING PLATEN PLATE WITH SUCTION HOLES

BACKGROUND OF THE INVENTION

1. Technical Field

The present invention relates to inkjet printers, and in particular to an inkjet printer adapted to make a print by propelling droplets of ink out of a print head onto a recording medium being sucked for transfer at an image forming section.

2. Background Arts

Inkjet printers capable of high-speed color printing and costing low have been remarkably widespread. Most types of inkjet printers are connectable to a terminal, such as a personal computer, to take in image data such as letters, illustrations, and marks, produced at the terminal, to print on a sheet. Composite types of inkjet printers have an integrated scanner or facsimile, to take in image data through the scanner and print them, or to receive image data at the facsimile and print them.

Some of those types of inkjet printers include a mechanism to transfer a recording sheet being sucked on a platen plate. The platen plate is arranged in position opposing an array of print heads in the image forming section. The recording sheet is carried by a transfer belt sliding on the platen plate. The recording sheet is locally sucked toward the platen plate by suction forces acting for transfer via the transfer belt. Such a mechanism can prevent recording sheets from getting wrinkles or rippling (cockling) or prevent recording sheets from curling at the image forming section. This allows recording sheets to be free from floating. As a result, it can serve to prevent interferences between a recording sheet and print heads (for instance, print-head eroding interferences), and to retain stable distances (head gaps) between a recording sheet and print heads. This allows for a stable printing and print image quality.

One might have enhanced suction force acting on a recording sheet to attain more stable printing and print image. However, as suction power is increased in places underneath print heads and in their vicinities, entrained air would flow at increased velocities. Such air flows would affect orbits of ink droplets propelled out of the print heads, causing degraded print qualities. Further, as air flows at increased velocities, it would have increased tendencies to induce mist from ink droplets. Such mist would smear recording sheets, causing the inkjet printer to be contaminated inside (machine interior contamination).

The Japanese Patent Application Laid-Open No. 2007-31007 discloses a sheet transfer mechanism for inkjet printers that has airflow controlling means for reducing airflows produced in the sheet transfer direction. This control is made in places underneath inkjet heads and in their vicinities to suppress the formation of ink mist. The sheet transfer mechanism has air conducting holes to be blocked, air conducting holes formed with a decreased density, and air conducting holes formed with reduced diameters, as specific examples of the airflow controlling means implemented at a platen plate. Such airflow controlling means can serve to prevent sheet contamination due to formation of ink mist at a front edge of recording sheet.

SUMMARY OF THE INVENTION

However, the sheet transfer mechanism disclosed in this Patent Literature lacks consideration for the following points.

There have been demands for inkjet printers to exhibit a high-speed printing performance for increasing the number of sheets printed per unit time. Using a sheet transfer mechanism for increasing the recording sheet transfer speed is needed to implement such a high-speed printing performance. However, when a recording sheet is transferred at a high speed relative to print heads, air is entrained by the recording sheet being transferred, constituting transfer winds. The transfer winds join, in part, to suction winds locally acting to suction the recording sheet. Therefore, local air in places underneath the print heads and in vicinities thereof tends to flow faster on the side of the front end of the recording sheet in the transfer direction. As a result, ink droplets propelled out of the print heads have affected orbits degrading print qualities. Further, as air flows faster, ink droplets easily induce the generation of mist, and the mist causes contamination of machine interior, recording sheet, etc.

On the contrary, one might weaken suction winds themselves to avoid airflows getting faster on the side of the front end of a recording sheet in the transfer direction. However, in this case, transfer winds entrained by the recording sheet would weaken suction winds on the side of the rear end of the recording sheet in the transfer direction. Therefore, since the recording sheet might tend to float on the side of the rear end in the transfer direction, such float could not retain stable distances between the recording sheet and the print heads. It might become difficult to attain a stable printing and print image quality. Further, airflows would undergo significant changes on both the side of the front end and the side of the rear end of the print sheet in the transfer direction, so that one might be anxious about degraded print image qualities.

The present invention has been invented as a solution to the above-noted issues. Accordingly, the present invention is intended to provide an inkjet printer adapted to suppress actions of transfer winds entrained by transfer of a recording medium, thereby reducing flows of air involved in suctioning the recording medium, at regions underneath arrays of ink discharge nozzles of a print head, and in vicinities thereof. This adaptation is intended to suppress mist formation of ink droplets, and prevent contamination of machine interior, recording medium, etc., while preventing the recording medium from floating.

The present invention is also intended to provide an inkjet printer adapted to prevent interferences between a recording medium and a print head, while suppressing degradation of print image quality.

As a solution to the above-noted issues, according to an aspect of embodiment of the present invention, an inkjet printer comprises a platen plate, and an inkjet type print head. The platen plate has suction holes pierced from an obverse side thereof to a reverse side thereof, and recess portions opened about the suction holes, respectively, toward the obverse side. The inkjet type print head is provided with arrays of ink discharge nozzles facing at least parts of the recess portions. An array of ink discharge nozzles is disposed in one of a front region and a rear region across a suction hole inside a recess portion of the platen plate in a transfer direction of a print sheet. The suction hole is formed to have a first flow rate of air in a first suction path formed by the suction hole and the one of the regions in which the array of ink discharge nozzles is disposed, and a second flow rate of air in a second suction path formed by the suction hole and the other region at the recess portion. The second flow rate is smaller than the first flow rate.

DESCRIPTION OF EMBODIMENTS

Figure 1:
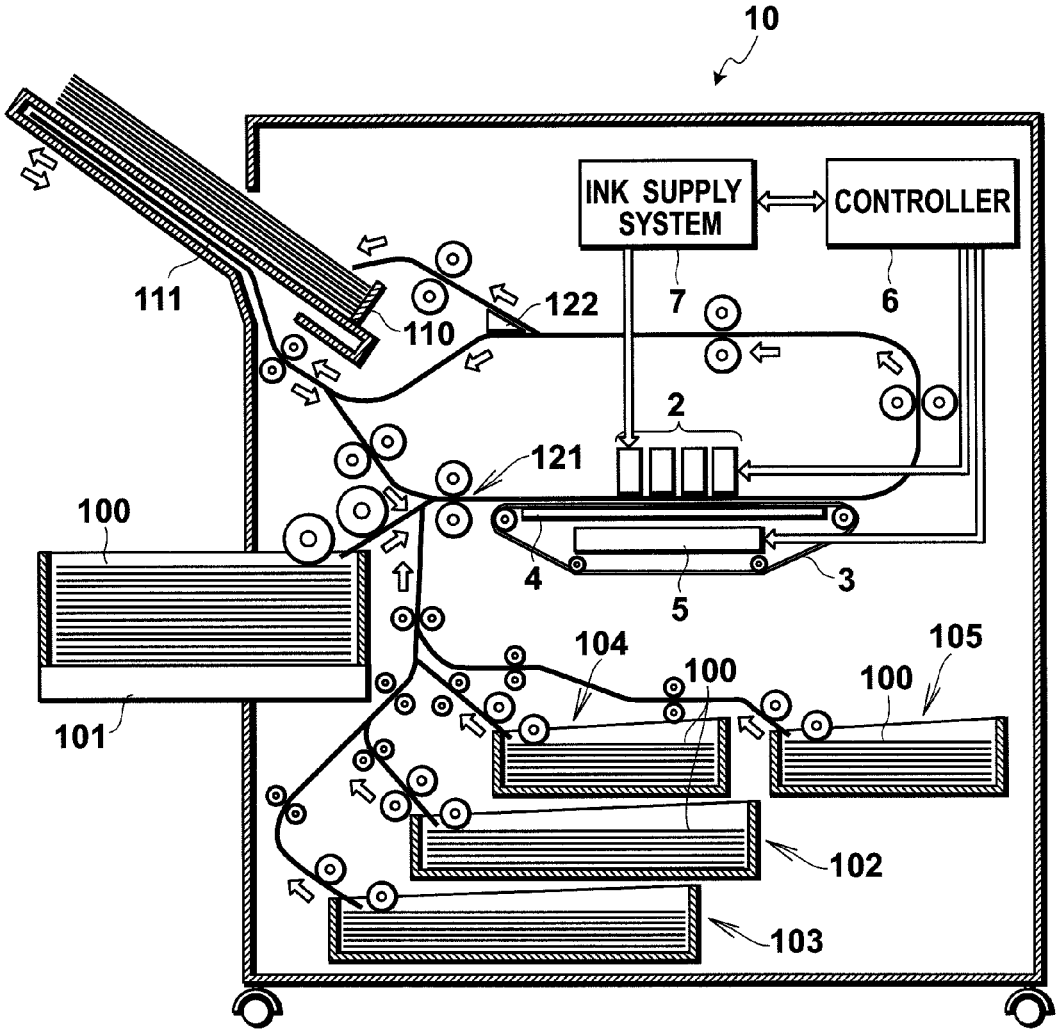
FIG. 1 is a schematic view of configuration of an inkjet printer according to a first embodiment of the present invention.

There will be described embodiments of the present invention with reference to the drawings. In the drawings, the same or similar components are designated at the same or similar reference signs. It is noted that the drawings is not real but typical.

The embodiments to be described below are illustrative to show specific apparatuses or methods implementing a technical concept according to the present invention. The technical concept of this invention does not restrict arrangements of components or the like to what will be described below. The technical concept of this invention can be modified in various manners, within the scope of claims.

(First Embodiment)

The first embodiment of the present invention describes an example of the present invention applied to a color inkjet printer that employs black ink, cyan ink, magenta ink, and yellow ink to make a print. It is noted that the present invention is applicable not simply to color inkjet printers, but also to inkjet printers for making monochrome prints including gray scaled prints.

[Machine Configuration of Inkjet Printer]

FIG. 1 shows an inkjet printer 10 according to the first embodiment that includes a transfer mechanism adapted to feed a recording medium 100, serve to have the recording medium 100 printed, and discharge the printed recording medium 100. The inkjet printer 10 includes a machine housing that has, at the left lateral side given no reference sign, a printing medium feed rack 101 detachably attached thereto, and projected outside the housing. The machine housing has therein several recording medium feed trays 102, 103, 104, and 105. The feed rack 101, as well as each feed tray 102 to 105, is adapted to store unprinted recording media 100 (prepared for print). The inkjet printer 100 has a recording medium mount rack 110 disposed at an upper left section of the machine housing. The mount rack 110 is adapted to receive printed recording media 100 discharged thereon (after print). It is now assumed to use recording sheets of paper as recording media 100. It is noted that the recording media 100 used may be any available media other than simple paper sheets, for instance, coat sheets coated with recording film, OHP (overhead projection) films (OHP sheets) for OHP use, resin discs, etc.

The inkjet printer 10 includes an array of inkjet type print heads 2. Each print head 2 has a multiplicity of ink discharge nozzles arrayed (as designated at reference signs 21 and 22 in FIG. 2 and FIG. 5) in a crossing direction (in a perpendicular direction in this case) with respect to the transfer direction of a recording medium 100 fed e.g. from the feed rack 101. There is an ink supply system 7 operatively connected to the set of print heads 2. The ink supply system 7 is put under control of a controller 6 adapted to govern performances of ink supply system 7 and individual print heads 2. Each print head 2 is operative to propel out droplets of black ink, cyan ink, magenta ink, or yellow ink, to make a print in a unit of line. That is, according to the first embodiment, the inkjet printer 10 is adapted to serve as a color inkjet printer employing a line print system.

The inkjet printer 10 includes an image forming section that has a platen plate 4 arranged in position opposing (underneath in FIG. 1) the array of print heads 2, with a transfer belt 3 intervening in between. The transfer belt 3 is made as an endless go-around belt to slide (travel) on the platen plate 14, to transfer (feed) a recording medium 100 onto the platen plate 4, and transfer (displace) the recording medium 100, as it is printed, on and out of the platen plate 4. Configurations of transfer belt 3 and platen plate 4 will be detailed later on.

A suction device 5 is disposed under the platen plate 4, that is, at the side opposite to (downwardly off in FIG. 1) the array of print heads 2. The suction device 5 has a function of suctioning a recording medium 100, with the transfer belt 3 intervening in between, to transfer the recording medium 100 to be printed in the image forming section. The first embodiment employs an air suction fan as the suction device 5. The suction device 5 is incorporated in the machine housing of the inkjet printer 10 in the first embodiment. Instead, it may be installed outside the machine housing of the inkjet printer 10, as an external device using a suction duct for a piping connection to the platen plate 4. The suction device 5 is connected to the controller 6, and operable under control of the controller 6.

It is noted that application of the inkjet printer 10 according to the first embodiment is not simply restricted to the system making a print in a unit of line. For instance, it may cover also serial systems scanning in a line direction to make a print.

[Printing Actions of the Inkjet Printer]

The inkjet printer 10 shown in FIG. 1 has the following printing actions. First, an unprinted recording medium 100 is fed from the feed rack 101 or any one of the feed trays 102 to 105. The recording medium 100 is transferred by drive mechanisms, which are made up by rollers or like though being undesignated by specific reference signs, along a transfer route in a medium feed system in the machine housing. The recording medium 100 is thus led to a register section 121. The register section 121 has functions of positioning a transferred recording medium 100, at the front edge in the feed direction, making a correction to avoid oblique travels, etc. The register section 121 includes a pair of register rollers opposing each other in a direction perpendicular to the transfer route in the feed system. The recording medium 100 transferred to the register section 121 is once stopped there, and afterward, it is transferred at a prescribed timing to the image forming section (as a printing section) in which the print heads 2 are arrayed.

There is a spatial region opposing the array of print heads 2, with the feed system's transfer route intervening in between. The transfer belt 3 is looped in that region, to work to carry a recording medium 100 at a transfer speed depending on a given printing condition. The transfer belt 3 is used to transfer the recording medium 100 on the platen plate 4. The print heads 2 are operable to propel out droplets of ink of different colors, onto the recording sheet 100 being transferred, to make thereon a color print, a monochrome print, or a gray scale print.

A printed recording medium 100 is transferred by drive mechanisms along a transfer route in a medium discharge system. For one-side printing, the recording medium 100 is lead as it is transferred to discharge. For both-side printing, the recording medium 100 as one-side printed is lead from the transfer rout in the discharge system, through a switching mechanism 122, to a switchback route 111. This recording medium 100 has a reversed side to be printed, to return to a transfer route in the feed system. The recording medium 100 as returned to the feed system's transfer route is transferred from the register section 121 to the image forming section, where it is printed, and afterward, the printed recording medium 100 is transferred along the discharge system's transfer route to discharge onto the mount rack 110, like the case of one-side printing.

[Configuration of the Image Forming Section]

As illustrated in FIG. 2, FIG. 3A, FIG. 3B, FIG. 4, and FIG. 5, the platen plate 4 provided in the image forming section of the inkjet printer 10 has recess portions 41 arranged over the area, including places thereon underneath the array of inkjet heads 2, with vicinities thereof inclusive. The recess portions 41 are regularly arrayed on an obverse side of the platen plate 4, and recessed from the obverse side toward a reverse side opposing the obverse side of the platen plate 4. There are prescribed sets of recess portions 41 combined with suction holes 42. The suction holes 42 are each respectively pierced from a partial region of a bottom surface of an associated recess portion 41, to the reverse side. In other words, the platen plate 4 has suction holes 42 pierced from the obverse side to the reverse side, and recess portions 41 each respectively opened about a corresponding one of the suction holes 42 toward the obverse side. Here, the obverse side of the platen plate 4 denotes a surface that the platen plate 4 has at the upside in FIG. 2, that is, a surface it has on the side coincident with the array of print heads 2. The reverse side of the platen plate 4 denotes a surface that the platen plate 4 has at the downside in FIG. 2, that is, a surface it has on the side coincident with the suction device 5.

Figure 3A:
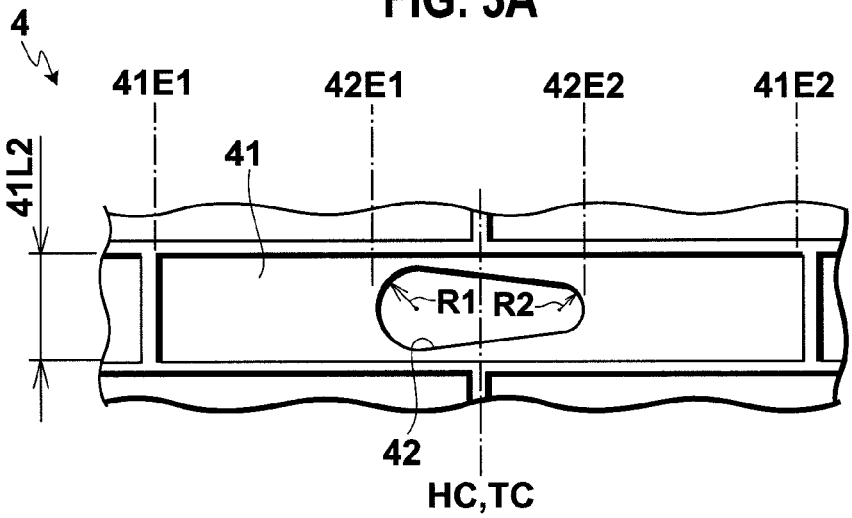
FIG. 3A is an enlarged plan view of the essential portion of the image forming section shown in FIG. 2.
Figure 3B:
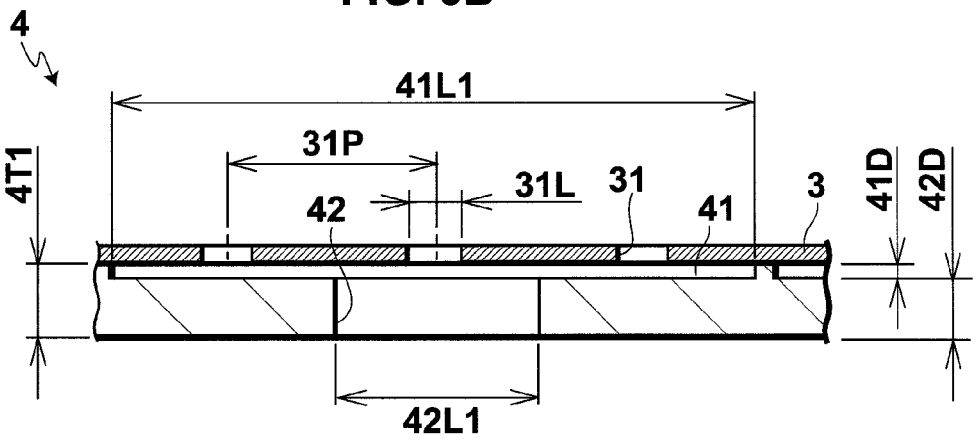
FIG. 3B is an enlarged sectional view of an essential portion corresponding to the plan view in FIG. 3A.

The platen plate 4 may be a metallic or resin plate, for instance. As illustrated in FIG. 3B, the platen plate 4 has a thickness 4T1, which may be set within a range of 2.5 mm to 7.0 mm, for instance.

Recess portions 41 in prescribed sets arrayed on the obverse side of the platen pate 4 are formed in a shape in plan (as an opening shape). Here, they are formed in a rectangular shape elongate in the transfer direction of a recording medium 100. FIG. 3B shows a recess portion 41 that has a length in the transfer direction (as a recess length) 41L1, which may be set within a range of 16 mm to 68 mm, for instance. The length 41L1 of the recess portion 41 is set equal to, or as a multiple of, an interval at which the print heads 2 are arrayed in the transfer direction denoted by an arrow in FIG. 4, that is, a transverse direction from the left to the right in FIG. 5. As shown in FIG. 3A, the recess portion 41 has a dimension (as a recess width) 41L2 in a direction intersecting the transfer direction, which dimension may be set within a range of 4 mm to 10 mm, for instance. As shown in FIG. 3B, the recess portion 41 has a depth (as a recess depth) 41D, which may be set within a range of ⅓.5 to ¼ of the thickness 4T1 of the platen plate 4, or near, that is, within a range of 0.5 mm to 2.0 mm, for instance. It is noted that, in FIG. 4 and FIG. 5, the left-hand side in the transfer direction with respect to the array of print heads 2 corresponds to an upstream end of the transfer direction, that is, a supply end of unprinted recording media 100. The right-hand side in the transfer direction with respect to the array of print heads 2 corresponds to a downstream end of the transfer direction, that is, an unloading end of a printed recording medium 100.

Figure 4:
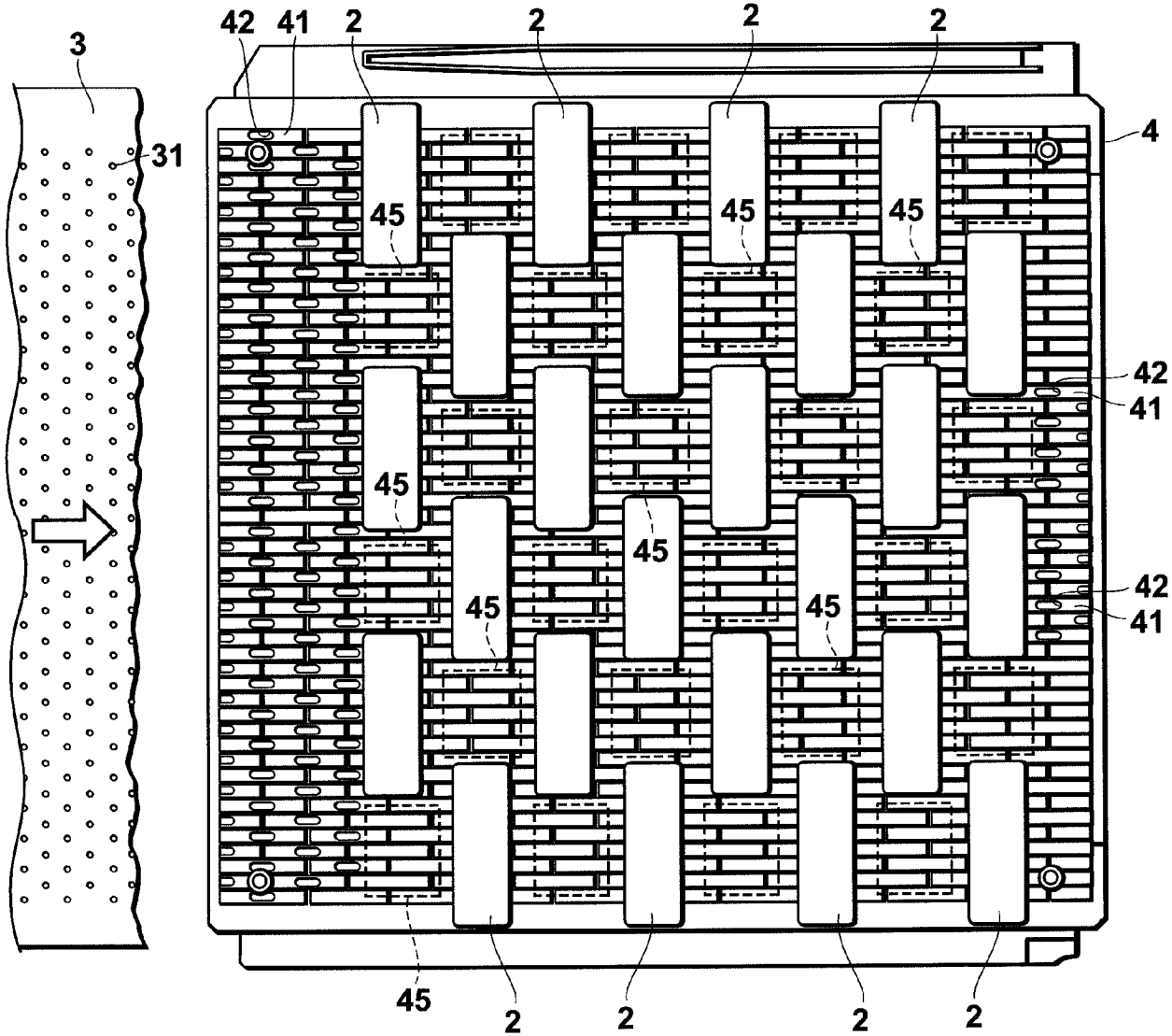
FIG. 4 is a plan view of the image forming section of the inkjet printer shown in FIG. 2.
Figure 5:
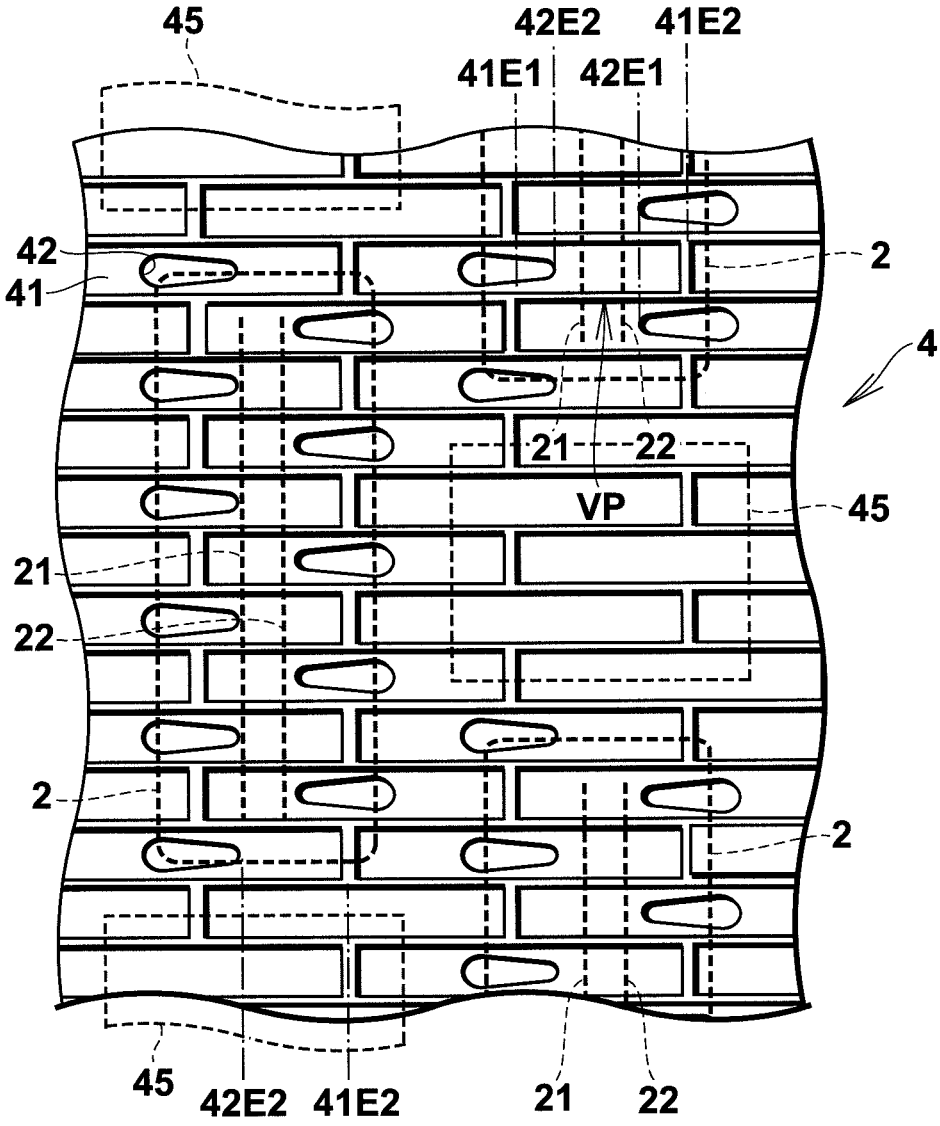
FIG. 5 is an enlarged plan view of an essential portion of the image forming section shown in FIG. 4.

FIG. 4 and FIG. 5 cooperatively show longitudinal arrays of recess portions 41 neighboring with each other in a direction intersecting the transfer direction (at right angles in this case). Recess portions 41 in any array are regularly positioned by a constant pitch in the transfer direction. This pitch is displaced by a half pitch between neighboring arrays. Accordingly, the recess portions 41 are arranged in a stagger pattern on the obverse side of the platen plate 4.

Figure 2:
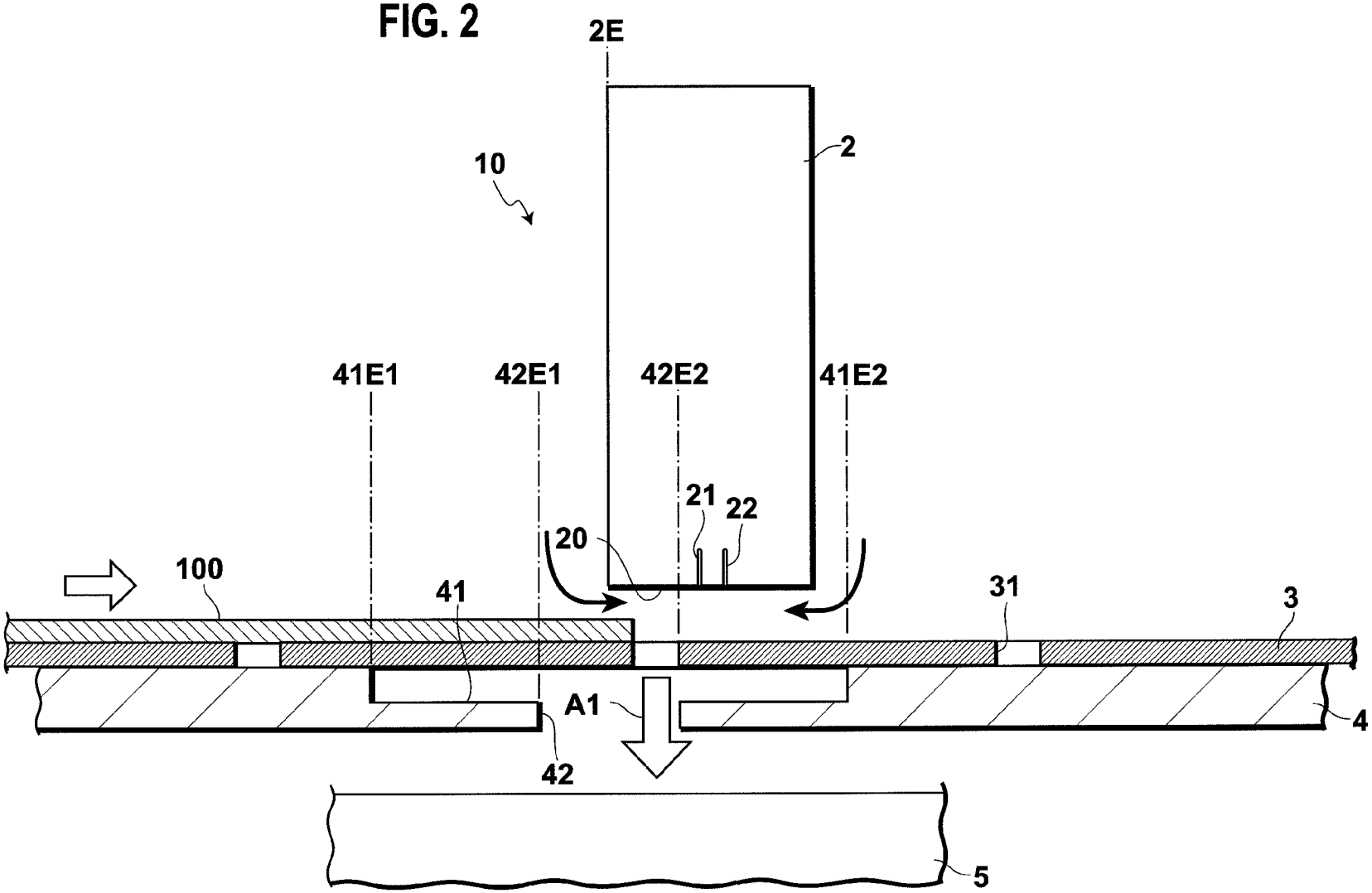
FIG. 2 is an enlarged sectional view of an essential portion of an image forming section of the inkjet printer according to the first embodiment.

Recess portions 41 each have a recessed bottom surface, which has a suction hole 42 disposed at a central part (as a partial region) thereof. The suction hole 42 is in air communication with a space confined under the platen plate 4, where the suction device 5 is installed. As illustrated in FIG. 2, FIG. 3A, and FIG. 5, in particular as in FIG. 3A, the suction hole 42 is formed in a shape in plan (as an opening shape) that is different in opening area between two sides of a center HC thereof in the transfer direction. The suction hole 42 has a spatial region extending from the center HC, on one of the two sides that is near to one (21 in this case) of arrays of ink discharge nozzles 21 and 22 of a corresponding print head 2. That region resides on the right side of the center HC in FIG. 3A, that is coincident with the downstream end in the transfer direction. The suction hole 42 has another spatial region extending from the center HC, on the other side that is far from the array of ink discharge nozzles 21. This region resides on the left side of the center HC in FIG. 3A, that is coincident with the upstream end in the transfer direction. The right region occupies part of an opening area of the suction hole 42. The left region occupies the remaining part of the opening area of the suction hole 42. The opening area of that region is set smaller than the opening area of this region. In other words, the suction hole 42 is shaped to open on one of two sides coincident with the right region with respect to the center HC in the transfer direction, with an area smaller than an opening area on the other side coincident with the left region. In this embodiment, any suction hole 42 is formed with an opening of which one part extends in a region on a left side of a center HC of the suction hole 42. That part of the opening has a shape defined in part with an arc described by a radius R1. The remaining part of the opening extends in a region on a right side of the center HC. This part of the opening has a shape defined in part with an arc described by a radius R2 smaller than the radius R1. The two shapes are combined with each other to constitute a shape in plan (an opening shape) of the suction hole 42 that is a tear shape elongate in the transfer direction, in comparison with dimensions in an intersecting direction thereto.

Here, the suction hole 42 shown in FIG. 3B has a length 42L1 in the transfer direction, which may be set within a range of 4 mm to 30 mm, for instance, to be shorter than the length 41L1 of the recess portion 41. The suction hole 42 shown in FIG. 3A has a radius R1 in the region at the left side of the center HC, which may be set within a range of 1.5 mm to 4.0 mm, for instance. This suction hole 42 has a radius R2 in the region at the right side of the center HC, which may be set within a range of 0.5 mm to 3.0 mm, for instance. The suction hole 42 shown in FIG. 3B has a length 42D occupying a major part of the thickness 4T1 of the platen plate 4. The length 42D may be set within a range of 2 mm to 5 mm, for instance.

In the first embodiment, suction holes 42 each have a center HC in the transfer direction. As illustrated in FIG. 3A, the center HC coincides with a center TC of an associated recess portion 41 in the transfer direction. That is, each suction hole 42 is arranged with its center HC coincident with a central part (about a center TC) of a recess portion 41.

In the first embodiment, all the recess portions 41 on the platen plate 4 are not provided with suction holes 42. As illustrated in FIG. 4 and FIG. 5, the platen plate 4 has suction holes 42 concentrated in places thereon underneath individual print heads 2, with vicinities thereof inclusive. Also, the platen plate 4 has suction holes 42 concentrated over an area thereof that receives part of a recording medium 100 just entering a zone in the image forming section in which the array of print heads 2 is arranged. Recoding media 100 may undergo moisture absorption, raised temperatures, or the like, whereby some recording media, for instance, recording sheets of paper may have extended circumferential dimensions causing them to locally float. Such recording sheets will float in part even when pressed with forces over the area. It therefore is necessary to densify suction holes 42 in allocations to prescribed regions including the area just before entry to the zone of the array of print heads 2 and the places under individual print heads 2 (regions overlapping the print heads 2). Those regions work as compulsory suction regions for suctioning a recording sheet onto the platen plate 4. They are effective to prevent interferences between a recording sheet and the print heads 2, and to retain stable head gaps in between. The remaining regions are non-suction regions 45 that work as float escape regions intentionally allowing a recording sheet to float. The non-suction regions 45 are disposed between the print heads 2 arrayed in a direction intersecting the transfer direction. The non-suction regions 45 are required to simply work, as described above, to allow a recording sheet to float, with allowances for floating tendencies to escape. Accordingly, suction holes 42 may well be allocated to the non-suction regions 45, with reduced densities to exert reduced suction forces on a recording sheet, relative to the regions overlapping the print heads 2. That is, each non-suction region 45 may well have a smaller number of suction holes 42 allocated per unit area thereon, than numbers of suction holes 42 allocated per unit area on the regions overlapping the print heads 2. In the first embodiment, the non-suction regions 45 have no suction holes allocated thereon.

Suction holes 42 are not allocated to any region (non-suction region 45) that does not need any specific suction hole. Suction holes 42 are allocated simply to regions (under the print heads 2) needing them. By doing so, the platen plate 4 can have a total open area reduced with an enhanced suction efficiency relative to a platen plate 4 assumed to have suction holes 42 secured over the entire region. The enhancement of suction efficiency allows for enhanced suction forces to act on a recording medium 100. This permits the suction device 5 to be minimized in size.

Since recess portions 41 and suction holes 42 are arrayed in a stagger pattern over regions on the platen plate 4, the suction holes 42 can be arranged dense, allowing for a secured even suction over the area of a recording medium 100. Suction holes 42 might not be staggered, but arrayed in a matrix pattern along the transfer direction and a perpendicular direction thereto. However, there would be regions disabled to suction between suction holes 42 neighboring with each other in the transfer direction or in an intersecting direction thereto. This state would weaken suction effects on a recording medium 100, giving the recording medium 100 increased tendencies to float at regions not suctioned.

The transfer belt 3 is made of a material such as rubber or resin that is flexible, and adapted to produce adequate friction forces on a recording medium 100. The transfer belt 3 is perforated with belt through-holes 31 arranged as illustrated in FIG. 2, FIG. 3B, and FIG. 4. The belt through-holes 31 admit fluxes of air under negative pressures (acting as suction forces) to pass therethough toward the suction device 5, forcing a recording medium 100 to be suctioned onto an obverse side of the transfer belt 3. Through-holes 31 in the transfer belt 3 have a shape in plan that may be a circular shape, for instance. FIG. 3B shows belt through-holes 31 formed with a diameter 31L, which may be set within a range of 1 mm to 3 mm, for instance. The belt through-holes 31 are arrayed by a pitch 31P in the transfer direction that is set smaller than the pitch of recess portions 41 arrayed in the same direction on the platen plate 4. The pitch 31P may be set within a range of 6 mm to 18 mm, for instance. Belt through-holes 31 are arrayed also in a direction intersecting the transfer direction by a pitch. As illustrated in FIG. 4, this pitch is set to a double of the pitch of recess portions 41 in the same direction in conformity with a stagger pattern of the recess portions 41. Belt through-holes 31 in any longitudinal array thereof are positioned by the pitch in the transfer direction. This pitch is displaced by a half pitch between longitudinal arrays of belt through-holes 31 neighboring with each other in a direction intersecting the transfer direction. Accordingly, belt through-holes 31 are arranged in a stagger pattern like recess portions 41 arrayed on the platen plate 4.

FIG. 2 shows a print head 2 that has a nozzle header with a face 20 opposing the obverse side of the platen plate 4, at a distance off to provide a head gap. The nozzle face 20 has arrays of ink discharge nozzles 21 and 22 arranged therein. In the first embodiment, each print head 2 has two arrays of ink discharge nozzles 21 and 22 arranged in a nozzle face 20 thereof. The two arrays of ink discharge nozzles 21 and 22 each have a multiplicity of ink discharge nozzles arrayed at constant intervals in a direction intersecting the transfer direction. In the first embodiment, one 21 of the two arrays of ink discharge nozzles is disposed upstream in the transfer direction, and the other array 22 of ink discharge nozzles is disposed downstream in the transfer direction. In other words, an inkjet type print head 2 is provided with arrays of ink discharge nozzles 21 and 22 having a nozzle face 20 on positions opposing at least parts of the recess portions 41.

Figure 6A:
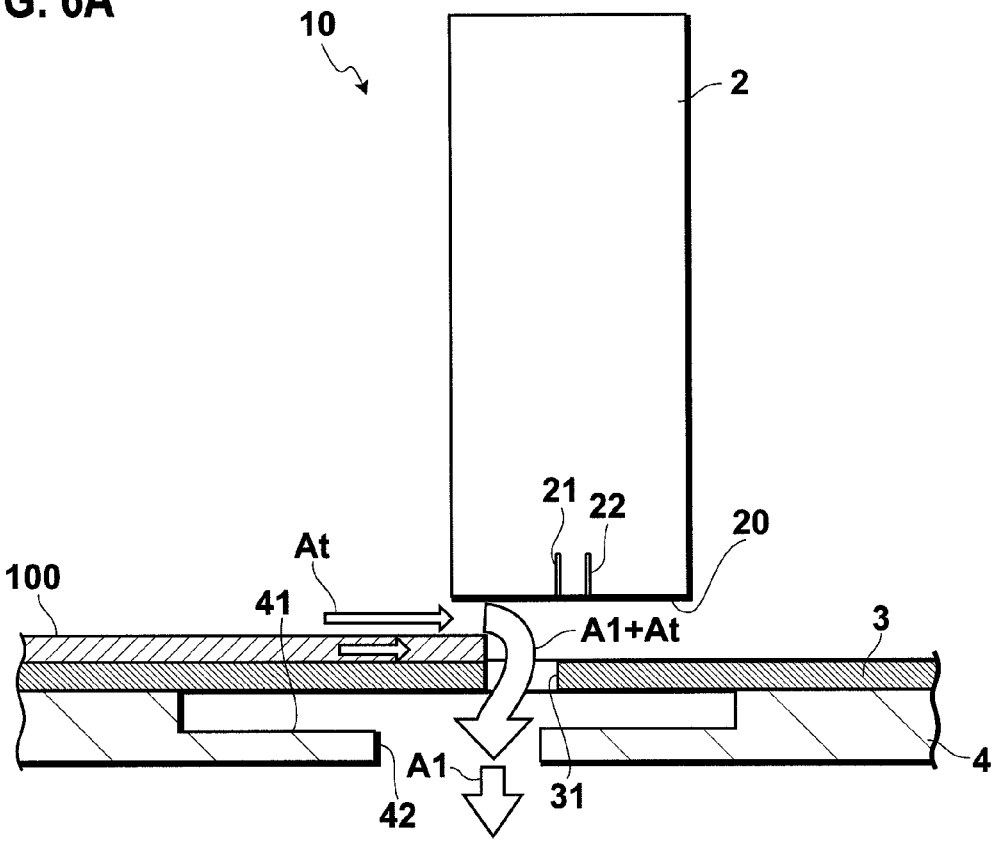
FIGS. 6A and 6B are enlarged sectional views of an essential portion for explaining actions of transfer winds at the image forming section of the inkjet printer according to the first embodiment.

FIG. 2 and FIG. 5 show the print head 2 that has the arrays of ink discharge nozzles 21 and 22 disposed between an opening end 41E2 of a recess portion 41 (referred to as a first opening end) and an opening end 42E2 of an associated suction hole 42 (referred to as a second opening end) in the platen plate 4. The first opening end 41E2 is an opening end of an interior region of the recess portion 41 excluding a spatial region extending right above the suction hole 42. FIG. 2 and FIG. 6A show the transfer belt 3 having a belt through-hole 31 residing in the spatial region extending right above the suction hole 42 of the platen plate 4, that is, a region overlapping the suction hole 42. FIG. 2 and FIG. 6A show also a recording medium 100 suctioned onto an obverse side of the transfer belt 3. The recording medium 100 has reached a position before entering a region extending underneath the arrays of ink discharge nozzles 21 and 22 of the print head 2.

This is a position the recording medium 100 has immediately after the front end thereof in the transfer direction has overlapped the most upstream circumference edge of the nozzle face 20 in the transfer direction.

In this situation, the belt through-hole 31 is straightly connected with a partial region in the recess portion 41 shown in FIG. 2, FIG. 3A, FIG. 3B, and FIG. 6A and a partial region in the suction hole 42 shown in FIG. 3A, constituting a first suction path admitting flows of air A1 to pass. The partial region in the recess portion 41 is one part thereof extending in the recess portion 41 on the near side to the arrays of ink discharge nozzles 21 and 22, overlapping them. That is a region extending from the center TC of the recess portion 41 to the first opening end 41E2. The partial region in the suction hole 42 is one part thereof extending on the near side to the arrays of ink discharge nozzles 21 and 22. That is a region extending from the center HC of the suction hole 42 to the second opening end 42E2. The first suction path thus penetrates the platen plate 4 from the obverse side to the reverse side. It is noted that the term 'first suction path' is not used to mean a path being produced, in particular in part thereof, with a region strictly defined over the area extending from the center HC of the suction hole 42 to the second opening end 42E2. But, it is used to mean a path admitting flows of air A1 to be dominant to pass the belt though hole 31, the one part of the recess portion 4, and the one part of the suction hole 42, to enter the suction device 5.

The first suction path has an opening area between the center HC of the suction hole 42 and the second opening end 42E2. This opening area is set small as shown in FIG. 3A. Therefore, suction power from the suction device 5 become small, and flows of air A1 become slow to pass the belt through-hole 31 and the suction hole 42, to the suction device 5. As a result, the flow rate (as a first flow rate) becomes small (that is, the air flow becomes small). According to the first embodiment, an array of ink discharge nozzles 21 or 22 is disposed in one of a front region and a rear region extending at a recess portion 41 of the platen plate 4, with a suction hole 42 intervening in between in a transfer direction of a print sheet 100. The suction hole 42 is formed to have a first flow rate of air A1 in a first suction path and a second flow rate of air A1 in a second suction path. The first suction path is made up by the suction hole 42 and the one of the regions in which the array of ink discharge nozzles 21 or 22 is disposed. The second suction path is made up by the suction hole 42 and another of the regions extending at the recess portion 41. The first flow rate is smaller than the second flow rate.

Figure 3C:
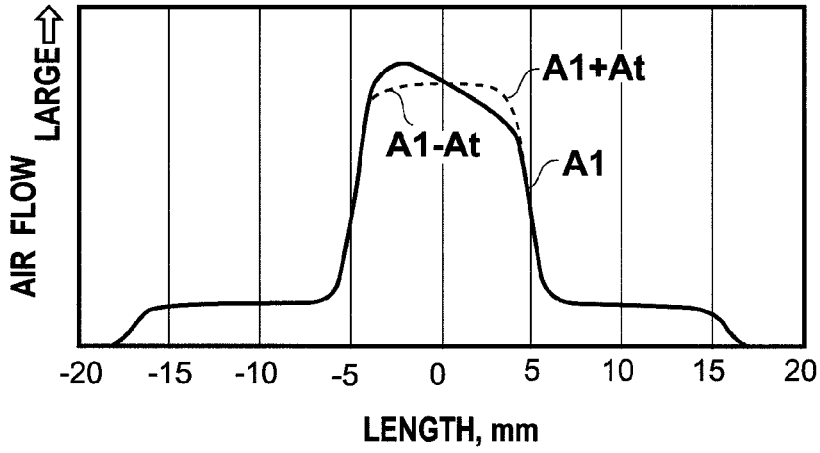
FIG. 3C is a graph of air flow distribution.

Air flows were measured at a belt through-hole 31 of a transfer belt 3, with a result shown in FIG. 3C. In FIG. 3C, the longitudinal axis represents air flows, and the horizontal axis represents lengths in mm. The lengths are associated with arrangement positions of the recess portion 41 and the suction hole 42 in the platen plate 4 shown in FIG. 3A and FIG. 3B. As will be apparent from FIG. 3C, air velocities become slow and suction power becomes weak when the first suction path works, that is, in the state shown in FIG. 2 and FIG. 6.

Description is now made of the state in which the first suction path works. As shown in FIG. 6A, when a recording medium 100 is transferred to the print head 2, transfer winds entrained by the transfer are produced (as additive pressure winds) +At the side of the front end of the recording medium 100. The transfer winds +At get stronger, as the recording medium 100 is transferred at a high speed in a progressing high-speed printing. The first suction path inherently has flows of air A1 entrained by suction of the suction device 5. The transfer winds +At are added to the flows of air A1 (A1+At), whereby air velocities get faster underneath the arrays of ink discharge nozzles 21 and 22 of the print head 2. In the inkjet printer 10 according to the first embodiment, the flow rate of the first suction path is set small by adjusting the opening shape (opening area) of the suction hole 42. Therefore, the air flow (as flow rate) can be made weaker than the case in which air flow is not adjusted, as shown by broken lines given the legend A1+At in FIG. 3C, while the air flow somewhat increases as the transfer winds At are added.

Figure 6B:
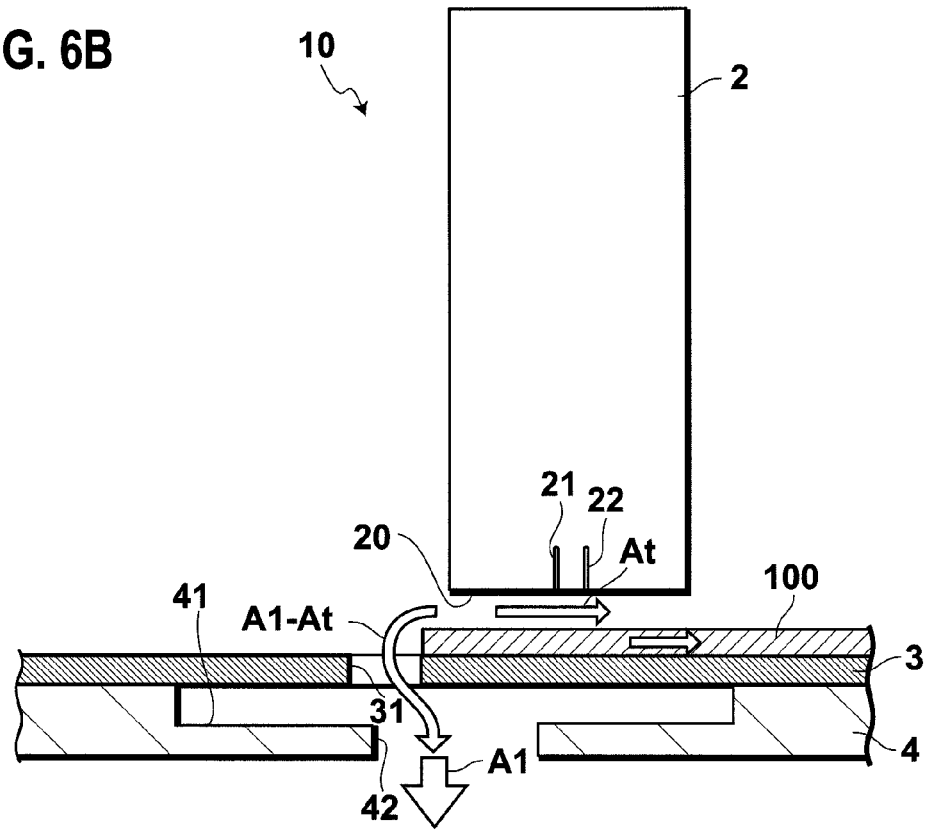

FIG. 6B shows a state of the transfer belt 3 in which a belt through-hole 31 resides in a region extending right above the suction hole 42 in the platen plate 4, that is, a region overlapping the suction hole 42, like the state shown in FIG. 6A. However, the state shown in FIG. 6B is different from the state shown in FIG. 6A, in position of the recording medium 100 suctioned onto the obverse side of the transfer belt 3. FIG. 6B shows a position the recording medium 100 has immediately before an end of a printing thereon. That is a position the recording medium 100 has immediately before the rear end thereof in the transfer direction comes up to a region extending underneath the arrays of ink discharge nozzles 21 and 22 of the print head 2.

In this situation, the belt through-hole 31 is straightly connected with a partial region in the recess portion 41 shown in FIG. 2, FIG. 3A, FIG. 3B, and FIG. 6B and a partial region in the suction hole 42 shown in FIG. 3A, constituting a second suction path admitting flows of air A1 to pass. The partial region in the recess portion 41 is the other part thereof extending in the recess portion 41 on the far side to the arrays of ink discharge nozzles 21 and 22. That is a region extending from the center TC to a third opening end 41E1 of the recess portion 41. The partial region in the suction hole 42 is the other part thereof extending on the far side to the arrays of ink discharge nozzles 21 and 22. That is a region extending from the center HC to a fourth opening end 42E1 of the suction hole 42. The second suction path thus penetrates the platen plate 4 from the obverse side to the reverse side. It is noted that the term 'second suction path' is not used to mean a path being produced, in particular in part thereof, with a region strictly defined over the area extending from the center HC of the suction hole 42 to the fourth opening end 42E1. But, it is used to mean a path admitting flows of air A1 to be dominant to pass the belt though hole 31, the other part of the recess portion 4, and the other part of the suction hole 42, to enter the suction device 5, like the first suction path.

The second suction path has an opening area between the center HC of the suction hole 42 and the fourth opening end 42E1. This opening area is set large as shown in FIG. 3A. Therefore, suction power from the suction device 5 becomes large, and flows of air A1 become fast to pass the belt through-hole 31 and the suction hole 42, to the suction device 5. As a result, the flow rate (as a second flow rate) becomes large (that is, the air flow becomes large).

Description is now made of the state shown in FIG. 6B in which the second suction path works. In this state, air velocities become fast, and suction power becomes strong, as is apparent from FIG. 3C. As shown in FIG. 6B, when a recording medium 100 is transferred under the print head 2, transfer winds entrained by the transfer (referred to as negative pressure winds in opposition to the additive pressure winds) −At are produced at the side of the rear end of the recording medium 100. The transfer winds −At act in a direction to weaken suction winds. The transfer winds −At get stronger, as the recording medium 100 is transferred at a high speed in a progressing high-speed printing. The second suction path inherently has flows of air A1 entrained by suction of the suction device 5. The transfer winds −At are subtracted from the flows of air A1 (A1−At), whereby air velocities get slower underneath the arrays of ink discharge nozzles 21 and 22 of the print head 2. In the inkjet printer 10 according to the first embodiment, the flow rate of the second suction path is set large by adjusting the opening shape (opening area) of the suction hole 42. Therefore, the air flow (as flow rate) can be made stronger in power than the case in which air flow is not adjusted, as shown by broken lines given the legend A1−At in FIG. 3C, while the air flow somewhat decreases as the transfer winds At are subtracted.

Further, in the inkjet printer 10 according to the first embodiment, a recording medium 100 is transferred from an upstream end in the transfer direction to the print head 2. In this course, the front end of the recording medium 100 in the transfer direction sequentially passes the second suction path and the first suction path. When the front end of the recording medium 100 in the transfer direction overlaps the second suction path, the opening area between the center HC of the suction hole 42 and the fourth opening end 42E1 is large, and transfer winds +At are added to flows of air A1. As a result, suction power becomes stronger, and air flows become faster. That is, suction forces get strong on the side of the front end of the recording medium 100 in the transfer direction, allowing for ensured suction onto the platen plate 4. Floating is thus prevented, permitting a stable head gap to be secured. The second suction path is spaced from the arrays of ink discharge nozzles 21 and 22 of the print head 2, at a greater distance than the first suction path. Therefore, when the second suction path is working, flows of air are kept from affecting orbits of ink droplets propelled out of the arrays of ink discharge nozzles 21 and 22. Also, mist generation from ink droplets can be reduced. As a result, interferences between the print head 2 and the recording medium 100 can be prevented.

When the front end of the recording medium 100 in the transfer direction overlaps the first suction path, it so follows as described above. Therefore, a stable head gap can be secured, and orbits of ink droplets can be kept from being affected, while reducing mist generation. Print image quality can thus be enhanced.

Further, in the inkjet printer 10, the rear end of the recording medium 100 in the transfer direction sequentially passes the second suction path and the first suction path, in the above-noted course in which the recording medium 100 is transferred from the upstream end in the transfer direction to the print head 2. When the rear end of the recording medium 100 in the transfer direction overlaps the second suction path, it so follows as described above.

When the rear end of the recording medium 100 in the transfer direction overlaps the first suction path, the opening area between the center HC of the suction hole 42 and the second opening end 42E2 is small, and transfer winds −At are subtracted from flows of air A1. As a result, suction power becomes still weaker, and air flows become still slower. That is, suction forces get still weaker on the side of the rear end of the recording medium 100 in the transfer direction. Therefore, when the first suction path is working, flows of air are kept from affecting orbits of ink droplets propelled out of the arrays of ink discharge nozzles 21 and 22. Also, mist generation from ink droplets can be reduced. Further, when the first suction path is working, suction is kept on, though air flows are slowed. Therefore, the rear end of the recording medium 100 in the transfer direction can be securely suctioned onto the platen plate 4. Floating is thus prevented, permitting a stable head gap to be secured. Therefore, ensured stable head gap permits orbits of ink droplets to be kept from being affected, allowing for reducing mist generation. Print image quality can thus be enhanced.

In the inkjet printer 10 according to the first embodiment, as shown in FIG. 2, the nozzle face 20 of the print head 2 has one part 2E of a most upstream end a circumference thereof in the transfer direction disposed in a region overlapping the suction hole 42. This arrangement makes effective use of the property that suction power is strong. Strong suction power at that part permits a recording medium 100 being transferred by the transfer belt 3 to be securely suctioned toward the platen plate 4, immediately before the recording medium 100 enters a region under the nozzle surface 20 of the print head 2. Therefore, the recording medium 100 can be prevented from floating, and a stable head gap can be secured.

In the inkjet printer 10 according to the first embodiment, as shown in FIG. 5, arrays of ink discharge nozzles 21 and 22 of any print head 2 are disposed in a spatial region that excludes a region right above a suction hole 42 of the platen plate 4. The spatial region extends between an opening end (as the first opening end) 41E2 of a recess portion 41 and an opening end (as the second opening end) 42E2 of the suction hole 42. The arrays of ink discharge nozzles 21 and 22 are disposed in a spatial region that excludes a region right above a suction hole 42 in a neighboring recess array in a direction intersecting the transfer direction. The spatial region extends between an opening end (as the third opening end) 41E1 of a recess portion 41 in the neighboring recess array and an opening end (as the fourth opening end) 42E1 of the suction hole 42 in the neighboring recess array. Since recess portions 41 and suction holes 42 are staggered to array on the obverse side of the platen plate 4, the arrays of ink discharge nozzles 21 and 22 are disposed in a spatial region extending right above a recess portion 41, overlapping the recess portion 4. The spatial region excludes any region extending right above a suction hole 42, at any location in a direction intersecting the transfer direction.

More specifically, FIG. 5 shows an upper right print head 2 that has two arrays of ink discharge nozzles 21 and 22. One 21 of the two arrays of ink discharge nozzles overlaps a recess portion 41 in a reference recess array. The recess portion 41 has a suction hole 42. There is a positional relationship among the nozzle array 21, the recess portion 41, and the suction hole 42. The other 22 of the two arrays of ink discharge nozzles of the print head 2 overlaps a recess portion 41 in a neighboring recess array in a direction intersecting the transfer direction. The recess portion 41 in the neighboring recess array is displaced by a half pitch relative to the recess portion 41 in the reference recess array. The recess portion 41 in the neighboring recess array has a suction hole 42. There is a positional relationship among the nozzle array 22, the recess portion 41 in the neighboring recess array, and the suction hole 42 in the neighboring recess array. This positional relationship is coincident with that positional relationship. In other words, one may assume a layout of one 21 of two arrays of ink discharge nozzles of one print head 2, a recess portion 41 overlapping it, and an associated suction hole 42, and a layout of the other 22 of the two arrays of ink discharge nozzles, a recess portion 41 overlapping it in a neighboring recess array, and an associated suction hole 42. The layouts have rotational symmetries through 180 degrees about an imaginary point VP. The point VP is an intersection between a centerline between the two arrays of ink discharge nozzles 21 and 22, and a centerline between a pair of half-pitch displaced arrays of recess portions 41 neighboring each other in a direction intersecting the transfer direction.

The platen plate 4 according to the first embodiment has recess portions 41 and suction holes 42 staggered to array thereon, as described above. The staggering ensures that suction forces evenly act on the area of a recording medium 100, keeping the recording medium 100 from floating. Instead, it involves increased suction power with increased air velocities. As a result, ink droplets tend to produce mist. For this prevention, the layouts described with reference to FIG. 5 are employed to apply to stagger arrayed suction holes 42. This application permits arrays of ink discharge nozzles 21 and 22 to be disposed in spatial regions overlapping recess portions 41, between stagger arrayed suction holes 42, excluding regions overlapping the suctions holes 42. This arrangement can serve as ensured countermeasures against mist generation.

Further, suction holes 42 arranged in regions overlapping at least the array of print heads 2 are formed in a shape in plan (as an opening shape) for arrangement to have rotational symmetries through 180 degrees. That is, between paired suction holes 42, one suction hole 42 is formed with an opening area set small (to admit small flow rates) in a near region to an array of ink discharge nozzles 21, and with an opening area set large (to admit large flow rates) in a far region. The other suction hole 42 is formed with an opening area set small (to admit small flow rates) in a near region to an array of ink discharge nozzles 22, and with an opening area set large (to admit large flow rates) in a far region. The paired suction holes 42 are associated with each other by a rotational symmetry relationship. They are each set up in the near region to the array of ink discharge nozzles 21 or 22, to suppress actions of transfer winds +At to be added to flows of air A1.

There are suction holes 42 arranged outside the regions overlapping the array of print heads 2. Those suction holes 42 do not have flows of air A1 or transfer winds +At affecting orbits of ink droplets, and are free from mist generation. Therefore, as shown on the left side of FIG. 4 according to the first embodiment, they are formed in an elongate circular shape that is elongate in the transfer direction, and has arc shapes at both ends in the transfer direction. It is noted that the suction holes 42 outside the regions overlapping the array of print heads 2 may have an identical opening shape to the suction holes 42 in the regions overlapping the array of print heads 2.

[First Modification]

Figure 7A:
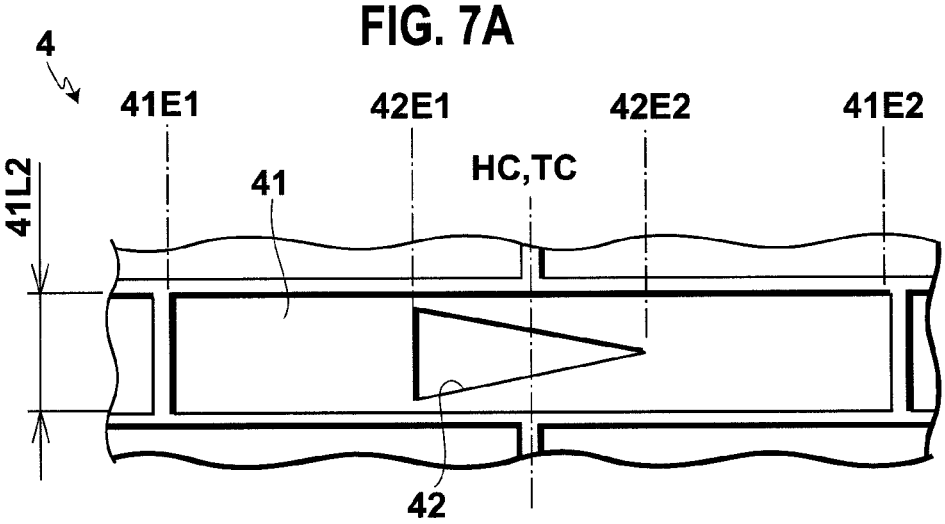
FIG. 7A is an enlarged plan view of an essential portion of an image forming section of an inkjet printer according to a first modification of the first embodiment of the present invention.

FIG. 7A shows a suction hole 42 in an inkjet printer 10 according to a first modification of the first embodiment. The suction hole 42 has an opening shape set to a triangular shape. The figure depicts no relations to arrays of ink discharge nozzles 21 and 22 of an array of inkjet heads 2. However, like the inkjet printer 10 according to the first embodiment, the suction hole 42 in the first modification is formed to have, about a center HC thereof, a flow rate set small (by allocation of a vertex of the triangular shape) in a near region to the arrays of ink discharge nozzles 21 and 22, and a flow rate set large (by allocation of a base of the triangular shape) in a far region.

[Second Modification]

Figure 7B:
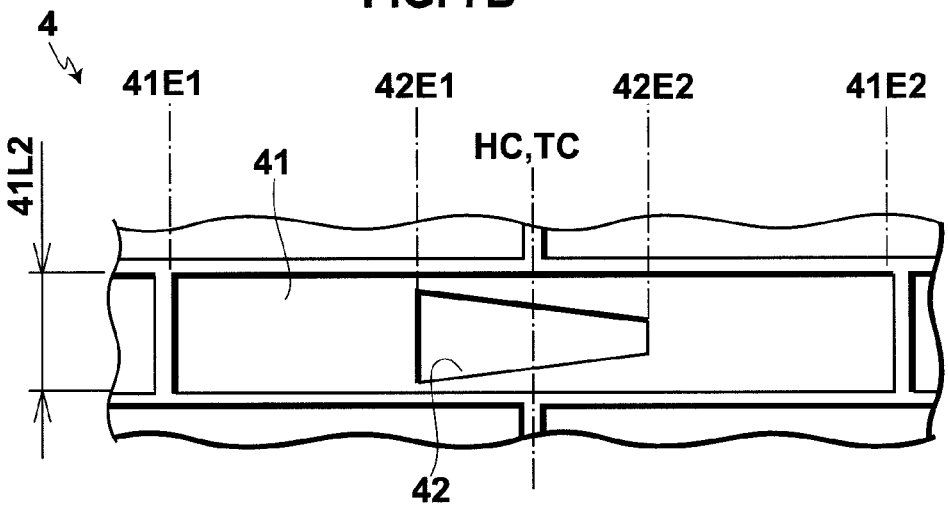
FIG. 7B is an enlarged plan view of an essential portion of an image forming section of an inkjet printer according to a second modification.

FIG. 7B shows a suction hole 42 in an inkjet printer 10 according to a second modification of the first embodiment. The suction hole 42 has an opening shape set to a trapezoidal shape. Like the inkjet printer 10 according to the first embodiment, the suction hole 42 in the second modification is formed to have, about a center HC thereof, a flow rate set small (by allocation of an upper base of the trapezoidal shape) in a near region to arrays of ink discharge nozzles 21 and 22, and a flow rate set large (by allocation of a lower base of the trapezoidal shape) in a far region.

[Third Modification]

Figure 7C:
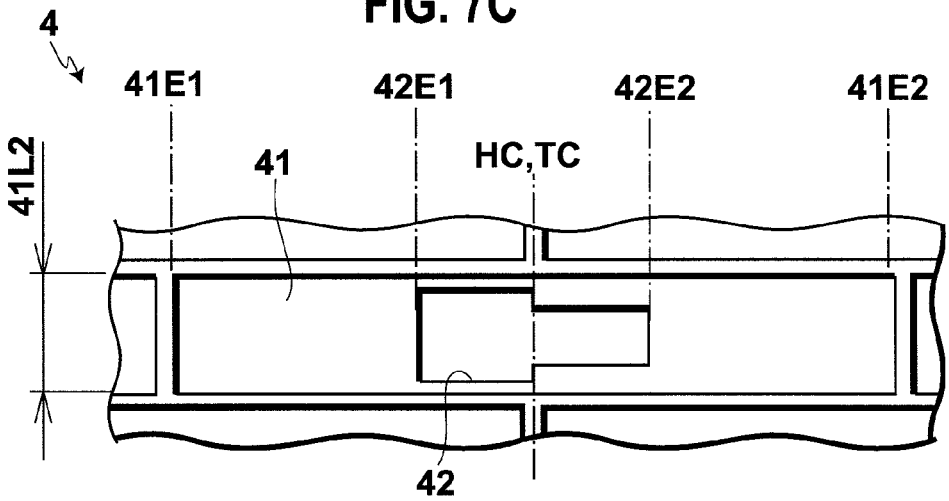
FIG. 7C is an enlarged plan view of an essential portion of an image forming section of an inkjet printer according to a third modification.

FIG. 7C shows a suction hole 42 in an inkjet printer 10 according to a third modification of the first embodiment. The suction hole 42 has an opening shape set to a convex shape. Like the inkjet printer 10 according to the first embodiment, the suction hole 42 in the third modification is formed to have, about a center HC thereof, a flow rate set small (by allocation of a stem of the convex shape) in a near region to arrays of ink discharge nozzles 21 and 22, and a flow rate set large (by allocation of a body of the convex shape) in a far region.

[Features of the First Embodiment]

As will be seen from the foregoing description, the inkjet printer 10 according to the first embodiment has, in the image forming section, the platen plate 4 including recess portions 41 and suction holes 42. A first suction path is made by a suction hole 42 and one part of a recess portion 41 in a transfer direction. A second suction path is made by the suction hole 42 and the other part of the recess portion 41 in the transfer direction. The first suction path is disposed in a region nearer to arrays of ink discharge nozzles 21 and 22 than the second suction path. A first flow rate of air in the first suction path is set smaller than a second flow rate of air in the second suction path. Therefore, transfer winds +At and flows of air A1 entrained by suction of a recording medium 100 are decreased in regions underneath arrays of ink discharge nozzles 21 and 22 of any print head 2 and in vicinities thereof. This arrangement can serve to suppress generation of mist of ink droplets, permitting prevention of contamination of machine interior, recording sheet, etc. Concurrently, the recording medium 100 can be kept from floating underneath the arrays of ink discharge nozzles 21 and 22. Since the floating of recording medium 100 is preventive, interferences between a recording medium 100 and ink discharge nozzles 21 and 22 can be prevented. It is ensured to retain a stable head gap. Also, flows of air can be reduced. Therefore, orbits of ink droplets can be kept from being affected, and mist generation can be reduced. As a result, print image quality is enhanced.

Further, in the inkjet printer 10 according to the first embodiment, the second suction path is disposed in a far region to arrays of ink discharge nozzles 21 and 22, to have a second flow rate set large. It therefore is possible to use strong suction power to prevent a recording medium 100 from floating on the side of the front end in the transfer direction, immediately before the recording medium 100 is transferred into a region under a nozzle face 20 of the print head 2. Hence, interferences are preventive between the recording medium 100 and the arrays of ink discharge nozzles 21 and 22. As a result, transfer of recording medium 100 can be remarkably improved to avoid faulty conditions. Also, the recording medium 100 can be securely suctioned toward the platen plate 4, with a retained stable head gap, allowing for an enhanced print image quality.

Further, in the inkjet printer 10 according to the first embodiment, the platen plate 4 in the image forming section has recess portions 41 and suction holes 42 arrayed in a stagger pattern, and arrays of ink discharge nozzles 21 and 22 are disposed between arrays of staggered suction holes 42 neighboring each other. Therefore, the staggered arrayed suction holes 42 can serve to suction a recording medium evenly and securely, preventing the floating. Concurrently, interferences are preventive between the recording medium 100 and the arrays of ink discharge nozzles 21 and 22. Further, a stable head gap can be retained underneath the arrays of ink discharge nozzles 21 and 22. Flows of air A1 can be reduced, and kept from affecting orbits of ink droplets. Also, generation of mist can be reduced, thus allowing for an enhanced print image quality.

(Second Embodiment)

Description is now made of a second embodiment of the present invention, as an example that includes a platen plate 4 in which recess portions 41 and suction holes 42 have a positional relationship altered relative to the image forming section of the inkjet printer 10 according to the first embodiment.

[Configuration of Image Forming Section]

Figure 8:
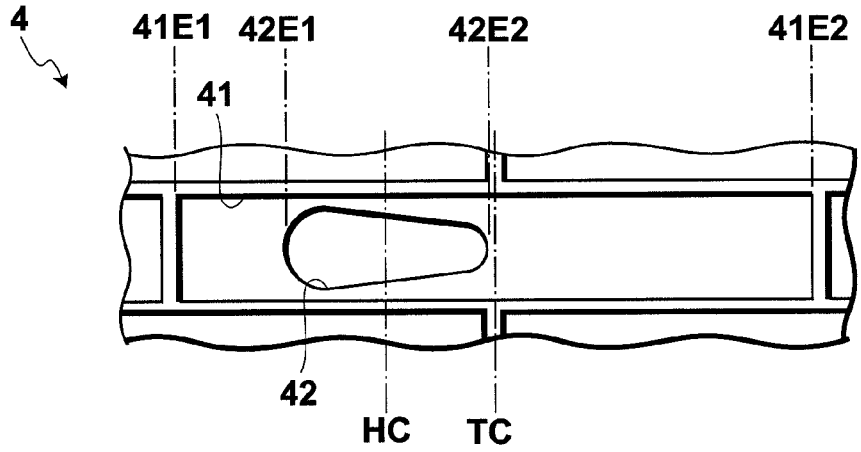
FIG. 8 is an enlarged plan view of an essential portion of an image forming section of an inkjet printer according to a second embodiment of the present invention.

FIG. 8 shows the paten plate 4 installed in an image forming section of an inkjet printer 10 according to the second embodiment, in which a suction hole 42 has a center HC thereof displaced in a transfer direction relative to a center TC of a recess portion 41 in the transfer direction. In FIG. 8, the center HC of the suction hole 42 is displaced upstream in the transfer direction relative to the center TC of the recess portion 41, into a region on a far side to arrays of ink discharge nozzles 21 and 22 of a print head 2. There is an associated suction hole 42 in a neighboring array in a direction intersecting the transfer direction (refer to FIG. 5). The associated suction hole 42 is associated by a rotational symmetry relationship, in a region overlapping the print head 2. The associated suction hole 42 has a center HC thereof displaced downstream in the transfer direction relative to a center TC of a corresponding recess portion 41, into a region on a far side to the arrays of ink discharge nozzles 21 and 22.

[Features of the Second Embodiment]

In the inkjet printer 10 according to the second embodiment, the platen plate 4 in the image forming section has recess portions 41 and suction holes 42, in which a first suction path is made by a suction hole 42 and one part of a recess portion 41 in the transfer direction. A second suction path is made by the suction hole 42 and the other part of the recess portion 41 in the transfer direction. The first suction path is disposed in a region nearer to the arrays of ink discharge nozzles 21 and 22 than the second suction path. A first flow rate of air in the first suction path is set smaller than a second flow rate of air in the second suction path. Therefore, this inkjet printer 10 can exhibit similar functions and effects to the inkjet printer 10 according to the first embodiment.

Further, in this inkjet printer 10, the center HC is displaced in the transfer direction relative to the center TC, thereby permitting the first suction path to be spaced away from the arrays of ink discharge nozzles 21 and 22. Therefore, flows of air accompanied by transfer winds +At can be still more slowed in places underneath the print head 2 or vicinities thereof.

(Third Embodiment)

Description is now made of a third embodiment of the present invention, as an example that includes a platen plate 4 in which first suction paths and second suction paths have shapes thereof altered relative to the image forming section of the inkjet printer 10 according to the first embodiment.

[Configuration of Image Forming Section]

Figure 9:
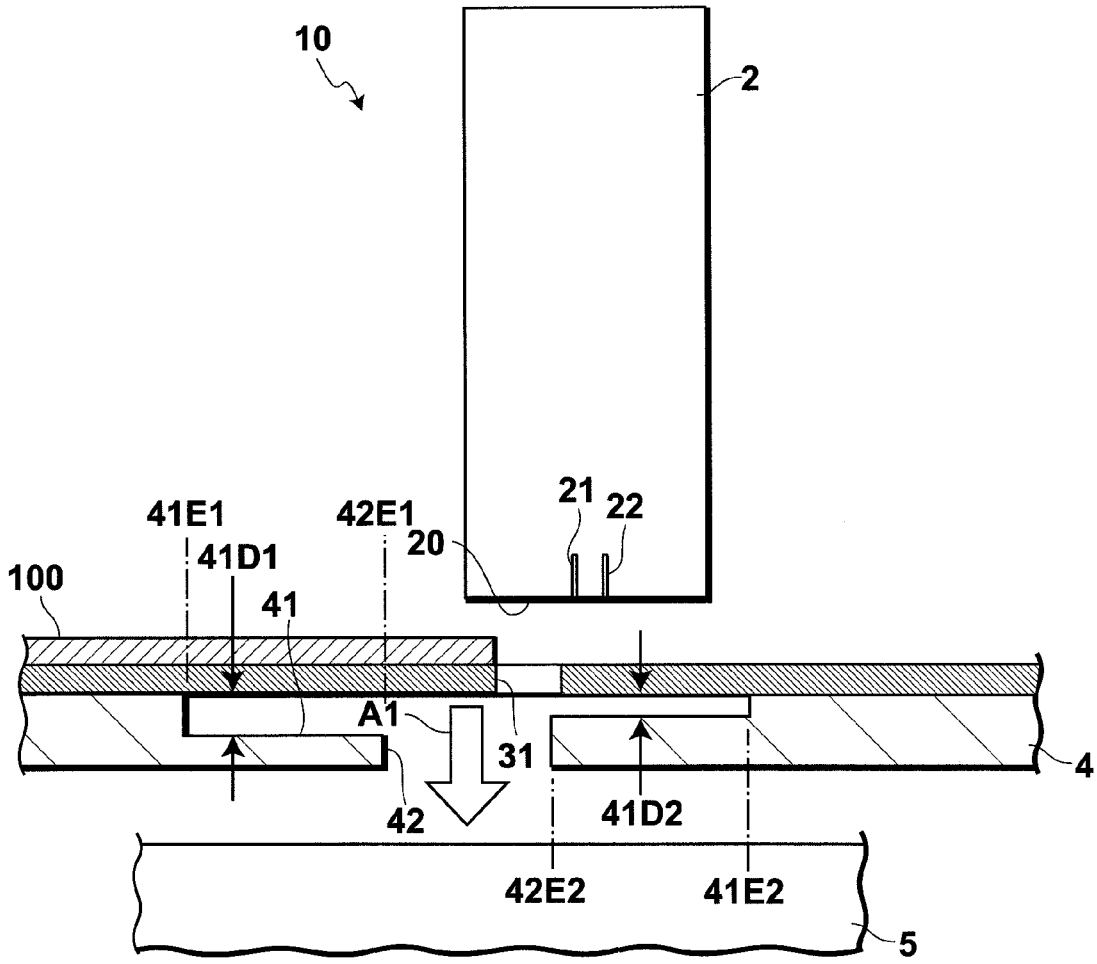
FIG. 9 is an enlarged sectional view of an essential portion of an image forming section of an inkjet printer according to a third embodiment of the present invention.

FIG. 9 shows the paten plate 4 installed in an image forming section of an inkjet printer 10 according to the third embodiment, in which a depth 41D2 of a recess portion 41 in a first suction path is set shallower than a depth 41D1 of the recess portion 41 in a second suction paths in the platen plate 4. The depth 41D2 of the recess portion 41 in the first suction path is a depth of the recess portion 41 from an obverse side of the platen plate 4 to an interior bottom thereof in a near region to arrays of ink discharge nozzles 21 and 22 of a print head 2. The first suction path, given the depth 41D2, has a decreased flow rate. The depth 41D11 of the recess portion 41 in the second suction path is a depth of the recess portion 41 from the obverse side of the platen plate 4 to an interior bottom thereof in a far region to the arrays of ink discharge nozzles 21 and 22 of the print head 2. The second suction path, given the depth 41D1, has an increased flow rate.

Further, in the third embodiment, the depths 41D1 and 41D2 of the recess portion 41 are adjusted to change flow rates of the first suction path and the second suction path. A suction hole 42 has an opening shape set even between an upstream side and a downstream side, about a center HC thereof. Suction holes 42 are formed with a shape in plan (as an opening shape), which may be an elongate circular shape elongate in a transfer direction, and have arc shapes at both ends in the transfer direction, for instance.

It is noted that the inkjet printer 10 according to the third embodiment may well be combined with one more of the inkjet printer 10 according to the first embodiment, the first to the third modification, and the second embodiment. More specifically, in the platen plate 4 of the inkjet printer 10 according to the third embodiment, suction holes 42 may have an opening shape set to a triangular shape, a trapezoidal shape, or a convex shape. Also, centers HC of suction holes 42 and centers TC of recess portions 41 may be displaced in the transfer direction.

[Features of the Third Embodiment]

In the inkjet printer 10 according to the third embodiment, the platen plate 4 in the image forming section has recess portions 41 and suction holes 42, in which a first suction path is made by a suction hole 42 and one part of a recess portion 41 in the transfer direction. A second suction path is made by the suction hole 42 and the other part of the recess portion 41 in the transfer direction. The first suction path is disposed in a region nearer to the arrays of ink discharge nozzles 21 and 22 than the second suction path. A first flow rate of air in the first suction path is set smaller than a second flow rate of air in the second suction path. Therefore, this inkjet printer 10 can exhibit similar functions and effects to the inkjet printer 10 according to the first embodiment.

(Other Embodiments)

Although the present invention has been described by way of examples using the first to the third embodiment, this invention should not be restricted by any phrases or drawings in the disclosure. The present invention is applicable to various substitute embodiments, embodiment examples, and application techniques. For instance, although the first to the third embodiment has described an inkjet printer 10 including a print head 2 provided with two arrays of inkjet discharge nozzles 21 and 22, the present invention may be applied to an inkjet printer including a print head provided with one or three or more arrays of inkjet discharge nozzles.

Further, according to the present invention, there may be an arrangement including three or more suction paths conducting air at different velocities, for instance, a combination of a first suction path, a second suction path, and a third suction path that have sequentially reduced suction power.

Further, the present invention may be applied not simply to printers provided with a printing function, but also to composite inkjet printers provided with a scanner function or facsimile function.

As will be seen from the foregoing description, according to the present invention, it is possible to provide an inkjet printer adapted to suppress actions of transfer winds entrained by transfer of a recording medium, in regions underneath arrays of ink discharge nozzles of a set of print heads and in vicinities thereof. Flows of air entrained by transfer of the recording medium can be reduced, and generation of mist of ink droplets can be suppressed, permitting preventions of contamination of machine interior, recording medium, etc. Concurrently, floating of the recording medium can be prevented.

Further, according to the present invention, interferences between a recording medium and print heads can be prevented, and degradation of print image quality can be suppressed.

The present application claims the benefit of priority under 35 U.S.C. §119 to Japanese Patent Application No. 2010-209762, filed on Sep. 17, 2010, the entire content of which is incorporated herein by reference.

What is claimed is:

1. An inkjet printer comprising:

a transfer belt having belt through holes;

a platen plate having suction holes pierced from an obverse side thereof to a reverse side thereof and recess portions opened about the suction holes, respectively, toward the obverse side; and a suction device that suctions a recording medium laid on the transfer belt through the belt through holes, the recess portions and the suction holes;

a print head provided with arrays of ink discharge nozzles facing at least parts of the recess portions and positionally fixed in relation to the platen plate, wherein an array of ink discharge nozzles is disposed in one of a front region and a rear region across a suction hole inside a recess portion of the platen plate in a transfer direction of a print sheet, the suction holes are disposed in an area that is not just beneath the arrays of ink discharge nozzles, the suction holes are formed to have a first flow rate of air generated by the suction device in a first suction path formed by the suction hole, the one of the regions where the array of ink discharge nozzles is disposed and the belt through hole in the one of the regions, and a second flow rate of air generated by the suction device in a second suction path formed by the suction hole, another of the regions at the recess portion and the belt through hole in the other of the regions, the first flow rate being smaller than the second flow rate, the suctions holes are further formed with an opening shape in which opening area on one side coincident with the one of the regions with respect to a center thereof in the transfer direction is smaller than an opening area on another side coincident with the other of the regions.

2. The inkjet printer according to claim 1, wherein each of the suction holes is formed with the center coincident with a center of the recess portion in the transfer direction.

3. The inkjet printer according to claim 1, wherein the suction hole is formed with the center deviated frontwards or rearwards in the transfer direction with respect to a center of the recess portion in the transfer direction.

4. The inkjet printer according to claim 1, wherein each of the suction holes is formed with an opening with a tear shape, a triangular shape, a trapezoidal shape, or a convex shape.

5. The inkjet printer according to claim 1, wherein the recess portion is formed shallower in the one of the regions than in the other of the regions.

* * * * *